US007452107B2

(12) United States Patent
Eckert et al.

(10) Patent No.: US 7,452,107 B2
(45) Date of Patent: Nov. 18, 2008

(54) ROTARY ACTUATOR WITH LIGHT GUIDES AND PHOTO-SENSOR

(75) Inventors: Gerold Eckert, Bad Neustadt a.d. Saale (DE); Haiko Glienicke, Salz (DE); Anton Ruettiger, Wildflecken (DE)

(73) Assignee: PREH GmbH, Bad Neustadt a.d Saale ( * ) Notice: Subject to any disclaimer, the term of this patent is extended or adjusted under 35 U.S.C. 154(b) by 101 days.

(21) Appl. No.: 11/584,511

(22) Filed: Oct. 23, 2006

(65) Prior Publication Data

US 2007/0052677 A1 Mar. 8, 2007

Related U.S. Application Data

(63) Continuation of application No. PCT/EP2005/004359, filed on Apr. 22, 2005.

(30) Foreign Application Priority Data

Apr. 22, 2004 (DE) ..... 10 2004 020 199
Apr. 28, 2004 (DE) ..... 10 2004 020 949

(51) Int. Cl.
*F21V 23/04* (2006.01)

(52) U.S. Cl. ..... 362/276; 362/26; 250/221

(58) Field of Classification Search ..... 362/26, 362/120, 276, 602; 250/221, 234.14
See application file for complete search history.

(56) References Cited

U.S. PATENT DOCUMENTS 5,168,268 A 12/1992 Levy
5,621,207 A * 4/1997 O'Mara ..... 250/221

FOREIGN PATENT DOCUMENTS

| | | |
|---|---|---|
| DE | 101 60 389 A1 | 8/2002 |
| DE | 103 42 335 A1 | 5/2005 |
| EP | 1 394 652 A1 | 3/2004 |
| WO | WO 2005/027168 A1 | 3/2005 |

* cited by examiner

*Primary Examiner*—Sandra O'Shea
*Assistant Examiner*—James W Cranson
(74) *Attorney, Agent, or Firm*—Muncy, Geissler, Olds & Lowe, PLLC

(57) ABSTRACT

A control element for a motor vehicle is disclosed that includes at least one rotary actuator and one actuating element integrated in the rotary actuator, whereby the actuating element can be moved relative to the rotary actuator, and whereby a connecting member, which interacts with an optical system, is molded to the actuating element. A connecting member extends into the optical system such that the deflection of the actuating element can be evaluated as a signal by the optical system. The optical system includes at least one light-emitting and at least one light-absorbing light guide element, whereby one light guide element is arranged on one side of the connecting member and one light guide element is arranged outside the connecting member so that a deflection of the actuating element is analogous to the absorption of light.

6 Claims, 3 Drawing Sheets

ROTARY ACTUATOR WITH LIGHT GUIDES AND PHOTO-SENSOR

This nonprovisional application is a continuation of International Application No. PCT/EP2005/004359, which was filed on Apr. 22, 2005, and which claims priority to German Patent Application Nos. DE 102004020199 and 102004020949, which were filed in Germany on Apr. 22, 2004, and Apr. 28, 2004, respectively, and which are all herein incorporated by reference.

BACKGROUND OF THE INVENTION

1. Field of the Invention

The present invention relates to a control element for a motor vehicle comprising at least one rotary actuator and one actuating element integrated in the rotary actuator, whereby the actuating element is movable relative to the rotary actuator, and whereby a connecting member, which interacts with an optical system, is molded to the actuating element, whereby a cylindrical, vertical extension of the connecting member extends into the optical system such that the deflection of the actuating element can be evaluated as a signal by the optical system.

2. Description of the Background Art

From German patent application DE 103 42 335, which is incorporated herein by reference, a rotary and/or pressure actuator having a joystick is known. This rotary and/or pressure actuator with joy stick function is a rotary and/or pressure actuator with a joystick integrated in the center. The joystick is pivotably integrated in the rotary/pressure switch and is movable relative to the rotary and/or pressure actuator. The deflection of the joystick, which is also referred to as an actuating element or control element, is registered via a connecting member that extends into an optical system of a photo transistor and illuminating means.

SUMMARY OF THE INVENTION

It is an object of the invention to provide a control element for high haptic requirements that can be evaluated in more than four actuating directions. Furthermore, a touch-free data logging takes place, which allows the detection of up to eight deflection directions of the joystick.

The optical system, according to an embodiment, includes at least one light-emitting and at least one light-absorbing light guide element, wherein one light guide element is arranged on one side of the connecting member and one light guide element is arranged on the other side of the connecting piece so that analogous to the deflection of the actuating element, the fraction of absorbed light can be evaluated.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
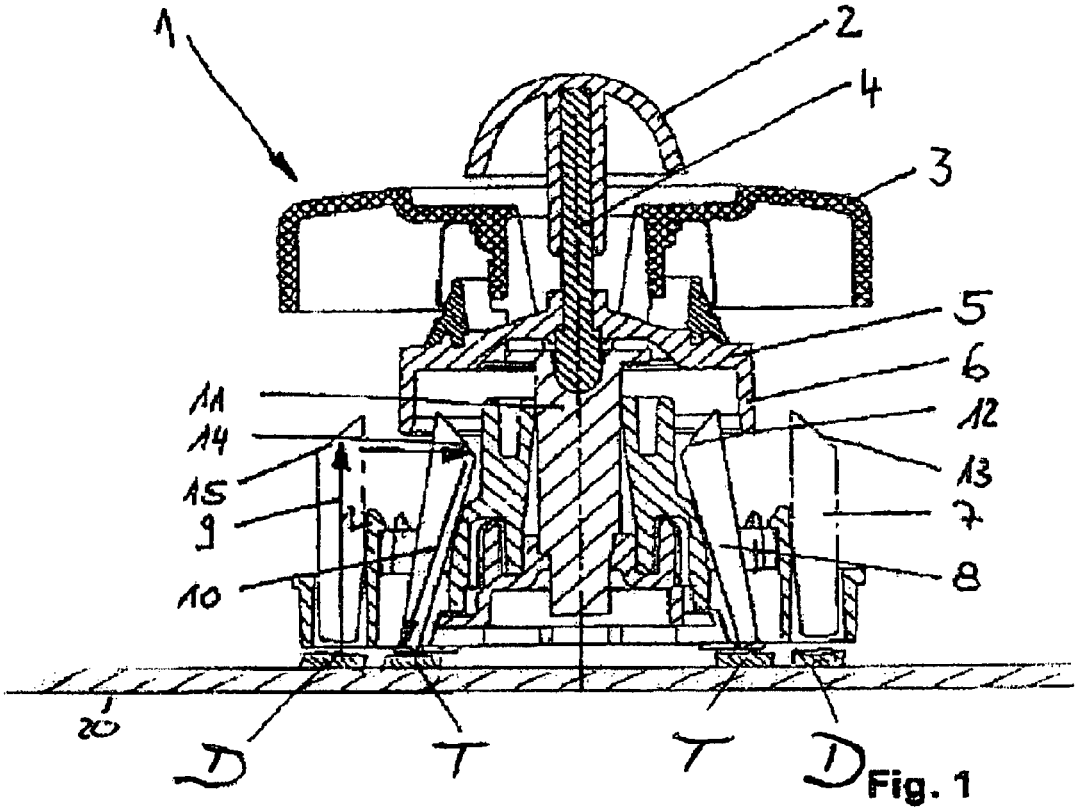
FIG. 1 shows a cross section of a control element according to an embodiment of the invention.

In FIG. 1, a cross section of a control element 1 of the present invention is illustrated. Essentially, the control element is comprised of an actuating element 2, which is arranged in a center of a rotary and pressure actuator 3. The actuating element 2 is positioned on top of a deflection axis 4, which in turn supports a connecting member 5. The connecting member has a cylindrical shell 6 extending in a vertical direction, which is arranged between two light guide elements 7, 8, and 9, 10. The deflection axis 4 is pivotably integrated in a guide axis 11. Located below the light guide elements 7, 8, 9, 10, is a circuit board 20, on which the light-emitting D and light-absorbing elements T are arranged.

In light guide elements 9, 10, the behavior of light L through the light guide elements is exemplified with arrows. By arranging the light guide elements 7, 8, 9, 10, in the control element 1, it is possible to arrange an evaluation method above the circuit board, which in turn substantially simplifies the construction of control element 1. By using slanted pieces 12, 13, 14, 15, in light guide elements 7, 8, 9, 10, any desired spread angle of the light is possible. Depending on the gradient of the slanted pieces 12, 13, 14, 15, the resolution, that is, the distance the connecting member 6 can be driven into the area of the light guide elements 7, 8, 9, 10, is adjustable. The path of the actuating element 2 and the precision, with which the deflection of the actuating element 2 is resoluble, can thus be variably and fixedly adjusted by the slanted pieces 12, 13, 14, 15, on light guide elements 7, 8, 9, 10.

Figure 2:
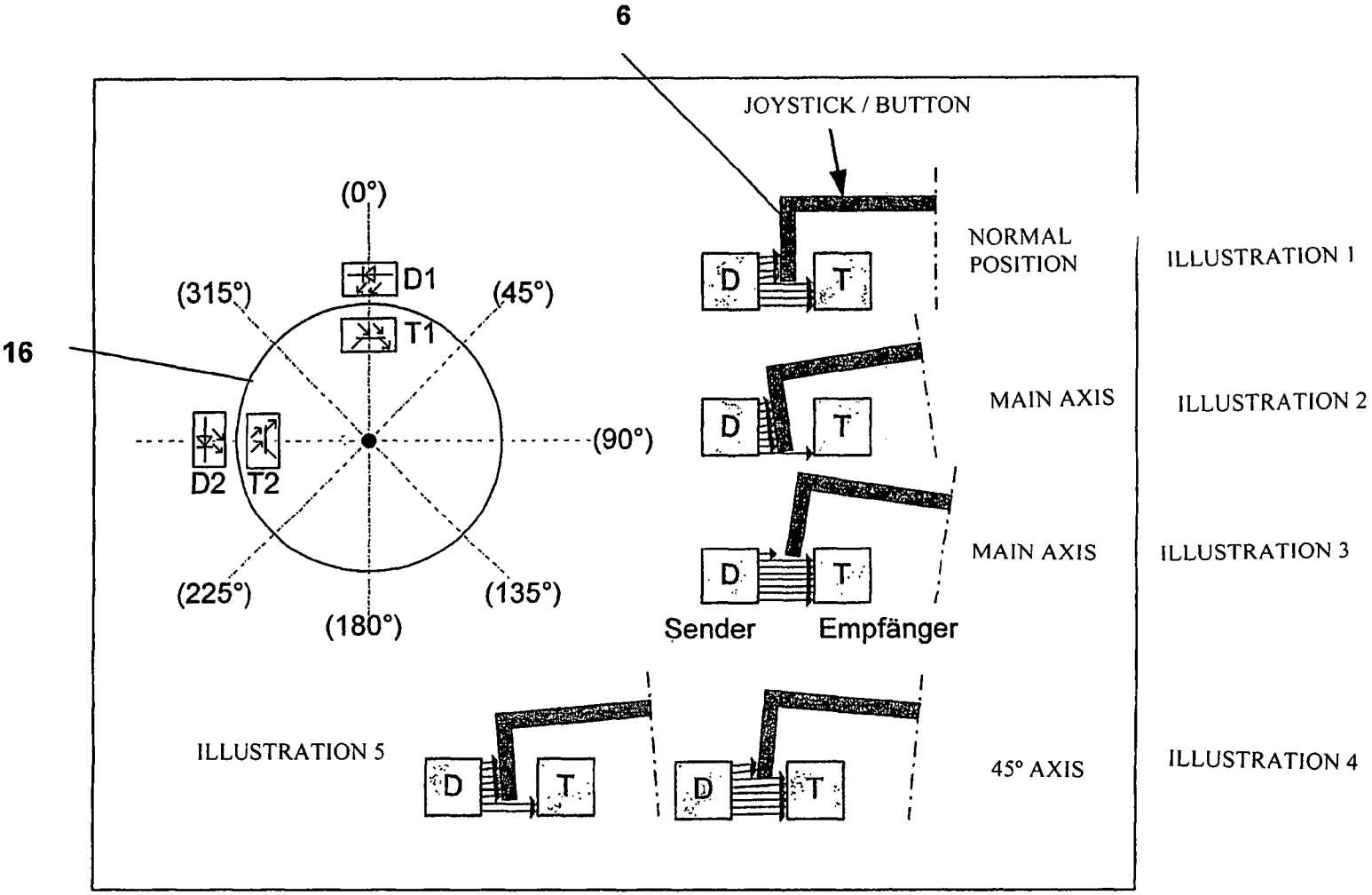
FIG. 2 is a schematic illustration of an analogous optical evaluation.

In FIG. 2, a basic construction of a control element 1 is roughly illustrated in a diagram. Circle 16 hereby schematically indicates connecting member 6, which is arranged between two optical systems D1, T1, and D2, T2. In this exemplary embodiment, the detection of the movement of actuating element 2 is thus registered by two optical systems comprised of transmitters D1, D2, and receivers T1, T2. What is of importance here is that for the detection of the pressure function on the rotary/pressure actuator, a third optical system D, T, is required. The arrangement of connecting member 6 between transmitter D and receiver T in an idle position is exemplified in the upper part of FIG. 2 (illustration 1).

If the actuating element 2 is actuated in the direction of the main axis directly in the direction of the main axis (0°), the connecting member 6 between transmitter D and receiver T is tilted. This is reflected in illustration 2 in FIG. 2. If, however, the actuating element 2 is actuated away from the main axis in a 180° direction, the connecting member 6 swivels out of the area of the transmitter and receiver D1, T1, and the receiver is completely exposed. This is shown in illustration 3 in FIG. 2. If, however, the actuating element 2 is actuated into an intermediate position, that is, for example, in a 315° direction, an evaluation would be detectable in the optical systems D1, T1, and D2, T2, as shown in illustration 5 in FIG. 2. However, if the actuating element 2 is actuated in a 135° direction, the connecting member 6 swivels out of the area of transmitter and receiver and assumes the position as is shown in illustration 4 in FIG. 2. Each one of these individual positions is clearly detectable. Only for the push position of control element 1, whereby both transmitters and receivers D1, T1, and D2, T2, can only be partially covered, is it not possible to detect with two optical systems. In a variation of the embodiment of the invention, it is suggested to arrange four optical systems offset by 90 degrees in the area of connecting member 6.

Figure 3:
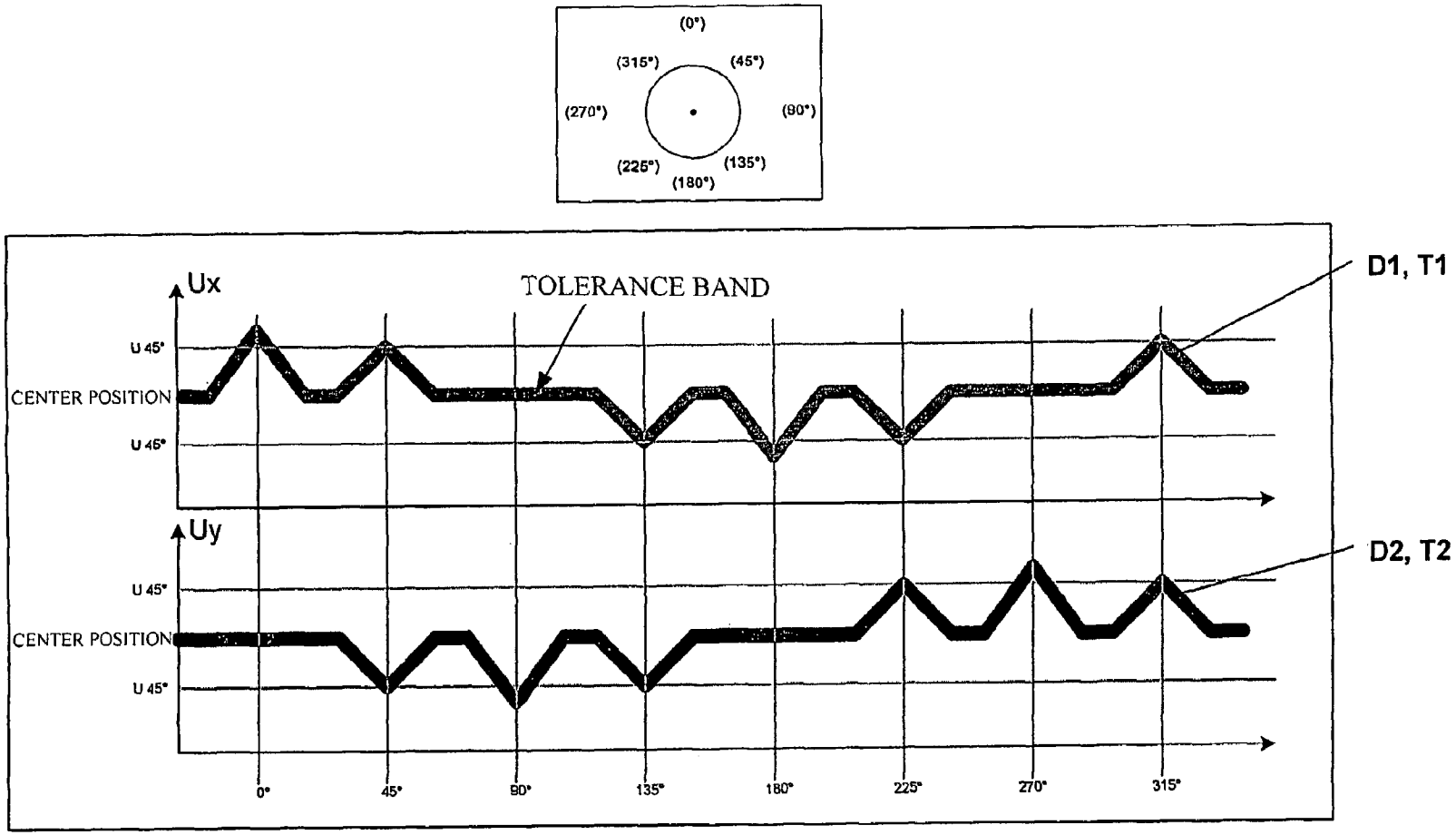
FIG. 3 shows evaluation curves in a graphic illustration.

In FIG. 3, an evaluation method with two optical systems is illustrated. If the actuating element 2 is actuated in a 0° direction as is shown in illustration 2 in FIG. 2, a high signal in the optical system can be evaluated. This condition is reflected in the curve in FIG. 3. The upper progression of the curve thus illustrates the evaluation curve of the optical system D1, T1.

In contrast, if the actuating element 2 is actuated in a 45° direction, the 45° can be evaluated in the optical systems D1, T1, and D2, T2, respectively. The further progression of the curve can be directly associated with the degree increments of the actuator below. In analogy thereto is the evaluation with four optical systems. In accordance thereto, four curves could be evaluated.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A control element for a motor vehicle comprising:

at least one rotary actuator;

at least one actuating element integrated in the rotary actuator, the actuating element being movable relative to the rotary actuator;

an optical system; and a connecting member, which interacts with the optical system, is molded to the actuating element, the connecting member extending into the optical system such that a deflection of the actuating element is evaluated as a signal by the optical system, wherein the optical system further comprises at least one light-emitting and at least one light-absorbing light guide element, and wherein the light-absorbing guide element is arranged on a side of the connecting member and the light-emitting guide element is arranged beyond a periphery of the connecting member so that a deflection of the actuating element is analogous to the absorption of light.

2. The control element according to claim 1, wherein the light-absorbing guide element and the light-emitting guide element extend from a circuit board arranged below the connecting member towards an area of the connecting member, and that an illuminating device is arranged on the light-emitting guide element, and a photo-sensitive sensor is arranged on the light-absorbing guide element.

3. The control element according to claim 1, wherein in the area of the connecting member, the light-emitting and light-absorbing guide element is formed such that the light from the light-emitter guide element to the light-absorber guide element is guidable via an inclined surface.

4. The control element according to claim 1, wherein the connecting member extends into the area between the light-emitter and light-absorber guide elements so that in an idle position, a fraction of the emitted light is covered by the connecting member.

5. The control element according to claim 1, wherein offset by 90 degrees, at least two optical systems are arranged at the periphery of the connecting member, and wherein the optical system has a transmitter, a receiver, and the light-emitting and light-absorbing guide elements.

6. The control element according to claim 1, wherein at the periphery and respectively offset by 90 degrees, four optical systems are arranged at the periphery of the connecting member.

* * * * *